US011423739B2

(12) United States Patent
Chan et al.

(10) Patent No.: US 11,423,739 B2
(45) Date of Patent: Aug. 23, 2022

(54) ELECTRONIC GAMING MACHINE

(71) Applicant: Aristocrat Technologies Australia Pty Limited, North Ryde (AU)

(72) Inventors: Matthew Chan, Gordon (AU); James Loader, Gosford (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

(21) Appl. No.: 16/714,561

(22) Filed: Dec. 13, 2019

(65) Prior Publication Data

US 2020/0320827 A1 Oct. 8, 2020

(30) Foreign Application Priority Data

Apr. 3, 2019 (AU) ..... 2019202309

(51) Int. Cl.
*G07F 17/32* (2006.01)

(52) U.S. Cl.
CPC ..... *G07F 17/3258* (2013.01); *G07F 17/3213* (2013.01); *G07F 17/3223* (2013.01)

(58) Field of Classification Search
CPC ..... G07F 17/3213; G07F 17/3258; G07F 17/3223
See application file for complete search history.

(56) References Cited

U.S. PATENT DOCUMENTS

2003/0064802 A1* 4/2003 Rodgers ..... G07F 17/3265 463/30
2004/0036218 A1* 2/2004 Inoue ..... G07F 17/34 273/292
2006/0052151 A1* 3/2006 Gomez ..... G07F 17/3244 463/16
2006/0205473 A1* 9/2006 Gomez ..... G07F 17/32 463/16
2010/0004050 A1* 1/2010 Caputo ..... G07F 17/3265 463/21
2010/0120492 A1* 5/2010 Davis ..... G07F 17/34 463/20
2012/0122545 A1* 5/2012 Watkins ..... G07F 17/3211 463/20
2012/0238348 A1* 9/2012 Aoki ..... G07F 17/34 463/21
2012/0322532 A1* 12/2012 Nauman ..... G07F 17/34 463/20
2014/0194182 A1 7/2014 Young

* cited by examiner

*Primary Examiner* — Steve Rowland
(74) *Attorney, Agent, or Firm* — Brownstein Hyatt Farber Schreck, LLP

(57) ABSTRACT

The disclosed technology relates to a method, system, and device for gaming including the display of a plurality of game symbols, each game symbol associated with one of at least two possible game actions. The game symbols associated with a first game action are displayed including a numerical prize value. Gameplay includes the selection of game symbols. In the event that a game symbol associated with a first game action is selected, its corresponding numerical prize value is award, for example added to a cumulative bonus prize, and the game symbol is then associated with the second game action. Typically, the visual representation of the game symbol is also changed, for example, the numerical prize value is removed.

20 Claims, 8 Drawing Sheets

300

| | Reel position | Reel 1 (321) | Reel 2 (322) | Reel 3 (323) | Reel 4 (324) | Reel 5 (325) |
|---|---|---|---|---|---|---|
| 301 | 1 | Pic 1 | 10 | Pic 3 | Q | Pic 1 |
| 302 | 2 | Wild | Q | K | A | 10 |
| 303 | 3 | J | K | 10 | 10 | J |
| 304 | 4 | Q | A | Q | Pic 2 | Pic 2 |
| 305 | 5 | 10 | Pic 2 | K | J | A |
| 306 | 6 | A | 9 | Pic 1 | Wild (331) | Q |
| 307 | 7 | Pic 2 | Wild | J | 9 | K |
| 308 | 8 | A | Pic 3 | K | 10 | Pic 2 |
| 309 | 9 | Q | Q | 9 | A | 9 |
| 310 | 10 | K | 10 | Q | Q | Wild |
| 311 | 11 | J | Pic 1 | 10 | J | 9 |
| 312 | 12 | 10 | Wild | Wild | K | Q |
| 313 | 13 | Pic 3 | K | Pic 2 | Wild | 10 |
| 314 | 14 | Wild | J | A | Pic 3 | Pic 3 |
| 315 | 15 | 9 | 10 | Wild | Pic 1 | A |

343 342 341

FIG. 3

ELECTRONIC GAMING MACHINE

CROSS-REFERENCE TO RELATED APPLICATIONS

This application claims priority to AU Application No. 2019202309 entitled "ELECTRONIC GAMING MACHINE" and filed on Apr. 3, 2019, which is hereby incorporated herein by reference.

FIELD

The present application relates to a gaming device and a method for operating a gaming device

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

The disclosed technology relates to a method, system, and device for gaming including the display of a plurality of game symbols, each game symbol associated with one of at least two possible game actions. The game symbols associated with a first game action are displayed including a numerical prize value. Gameplay includes events where game symbols are selected. In the event that a game symbol associated with a first game action is selected, its corresponding numerical prize value is awarded, for example added to a cumulative bonus prize, and the game symbol is then associated with the second game action. Typically, the visual representation of the game symbol is also changed, for example, the numerical prize value is removed.

An embodiment of the disclosed technology provides a method for operating a gaming device. The method of this embodiment comprises determining a current game state and displaying a visual representation of the current game state comprising a plurality of game symbols. Each game symbol is associated with one of a first game action and a second game action. Each game symbol associated with a first game action is associated with a prize award. The method also comprises performing a game instance comprising selecting a game symbol from the plurality of game symbols. Then, the method determines that the selected game symbol is associated with the first game action and awarding a prize associated with the selected game symbol. The association of the selected game symbol is changed from the first game action to the second game action thereby creating a new game state. The method then comprises displaying a visual representation of the change in association of the selected game symbol and performing a second game instance utilizing the new game state as the current game state. According to this embodiment, the initial game state comprises at least one game symbol associated with the first game action and at least one game symbol associated with the second game action, and wherein the second game action is associated with a secondary game event.

Another embodiment of the disclosed technology is a gaming device comprising a display, a processor, and a memory storing instructions. When the instructions are executed by the processor, they cause the processor to determine a current game state and display a visual representation of the current game state comprising a plurality of game symbols, where each associated with one of a first game action and a second game action, and where each game symbol associated with a first game action is associated with a prize award. The processor is also caused to perform a game instance comprising selecting a game symbol from the plurality of game symbols. When the processor determines that the selected game symbol is associated with the first game action, the one or more processors are caused to award a prize associated with the selected game symbol and change the association of the selected game symbol from the first game action to the second game action thereby creating a new game state. The processor then causes the display of a visual representation of the change in association of the selected game symbol. The processor is then caused to perform a second game instance utilizing the new game state as the current game state. According to this embodiment, the initial game state comprises at least one game symbol associated with the first game action and at least one game symbol associated with the second game action, and wherein the second game action is associated with a secondary game event.

Another embodiment of the disclosed technology is a gaming device comprising a display, one or more processors, and at least one memory storing instructions. When the instructions are executed by the one or more processors, they cause the one or more processors to determine a current game state and display a visual representation of the current game state comprising a plurality of game symbols, where each associated with one of a first game action and a second game action, and where each game symbol associated with a first game action is associated with a prize award. The one or more processors are also caused to perform a game instance comprising selecting a game symbol from the plurality of game symbols. When the one or more processors determine that the selected game symbol is associated with the first game action, the one or more processors are caused to award a prize associated with the selected game symbol and to change the association of the selected game symbol from the first game action to the second game action thereby creating a new game state. The one or more processors then cause the display of a visual representation of the change in association of the selected game symbol. The one or more processors are then caused to perform a second game instance utilizing the new game state as the current game state. According to this embodiment, the initial game state comprises at least one game symbol associated with the first game action and at least one game symbol associated with the second game action, and wherein the second game action is associated with a secondary game event.

Another example embodiment is a system comprising at least one processor; and a memory storing instructions which when executed by the at least one processor cause the at last one processor to: control a display to display a visual representation of a current game state comprising a plurality of game symbols associated with a first game action, wherein each game symbol associated with the first game action is associated with a prize; perform a first selection in which a first game symbol is selected from the plurality of game symbols associated with the first game action; control the display to display the first selected game symbol associated with the first game action; alter the first selected game symbol from the first game action to an altered game symbol associated with a second game action; and control the display to display an animation showing the alteration of the first selected game symbol. In particular example implementations, the second game action includes at least one symbol that triggers a reset condition. In one example, the reset condition results in a new game state that is different from the current game state. In some example implementations, the instructions, which when executed by the processor, cause the processor to: perform a second selection in which a game symbol is selected from the plurality of game symbols associated with the second game action in which the altered game symbol is available for selection; and control the display to display the second selected game symbol associated with the second game action. In certain example implementations, the first game action is part of a secondary game feature triggered by achievement of a result from a primary game. In some example implementations, the reset condition returns game symbols of the secondary game feature to an initial condition. In certain example implementations, the plurality of game symbols associated with the first game action game is variable dependent on an outcome of the primary game. In some example implementations, the plurality of game symbols associated with the second game action includes a game symbol for a progressive prize. In certain example implementations, the altered game symbol is for a previously unavailable progressive prize. In some example implementations, the second game action is triggered by a selection of a particular game symbol in the outcome of the first game action. In certain example implementations, the altering is performed responsive to a particular set of game symbols resulting from the first game action. In some example implementations, the prize associated with the selected game symbol includes a numerical prize that is added to a cumulative bonus prize. In certain example implementations, the selected game symbol is selected in accordance with a probability set defining the probability of selecting each game symbol. In some example implementations, the memory storing instructions which when executed by the processor further causes the processor to repeat game instances of the first game action until achievement of a game symbol associated with the second game action. In further example implementations, the memory storing instructions which when executed by the processor further causes the processor to, upon the achievement of the game symbol associated with the second game action, initiate the control of the display to display the animation showing the alteration of the first selected game symbol. In some example implementations, one or more game symbols associated with the second game action do not display a numerical value. In certain example implementations, at least one of the altered one or more of the plurality of game symbols of the secondary game features includes at least one of the selected one of the plurality of game symbols. In some example implementations, at least one of the altered one or more of the plurality of game symbols of the secondary game feature provides a greater award than an earlier award. In certain example implementations, the first selected game symbol associated with the first game action is displayed as a pie slice of a computer-generated rotating wheel. In some example implementations, the first game action is part of a secondary game feature triggered by achievement of a result from a reel game, and wherein the first and second game action are displayed simultaneously with the reel game. In certain examples, the system comprises an electronic gaming machine ("EGM") or the system is a server in communication with one or more EGMs.

BRIEF DESCRIPTION OF THE DRAWINGS

FIG. 3 illustrates an example reel strip layout.

DETAILED DESCRIPTION

The detailed description presents innovations in user interface ("UI") features of electronic gaming devices, as well as innovations in features of back-end processing to implement the UI features. For example, in some embodiments, the display is controlled so that a visual representation of a primary game is displayed together with a secondary game feature. In the display, one of a plurality of game symbols is available for selection. Upon a particular result being selected for the primary game, a secondary game feature is triggered. In such an event, and in certain embodiments, one or more of the game symbols of the secondary game feature are altered after being selected. Further, an animation showing the alteration of the altered one or more of the plurality of game symbols of the secondary game feature can be displayed. In some embodiments, at least one of the altered game symbols can be a trigger for a reset condition that, if selected, results in a new game state that is different from the current game state (and, in some cases, returns the game symbols of the secondary game feature to their initial state).

Figure 1:
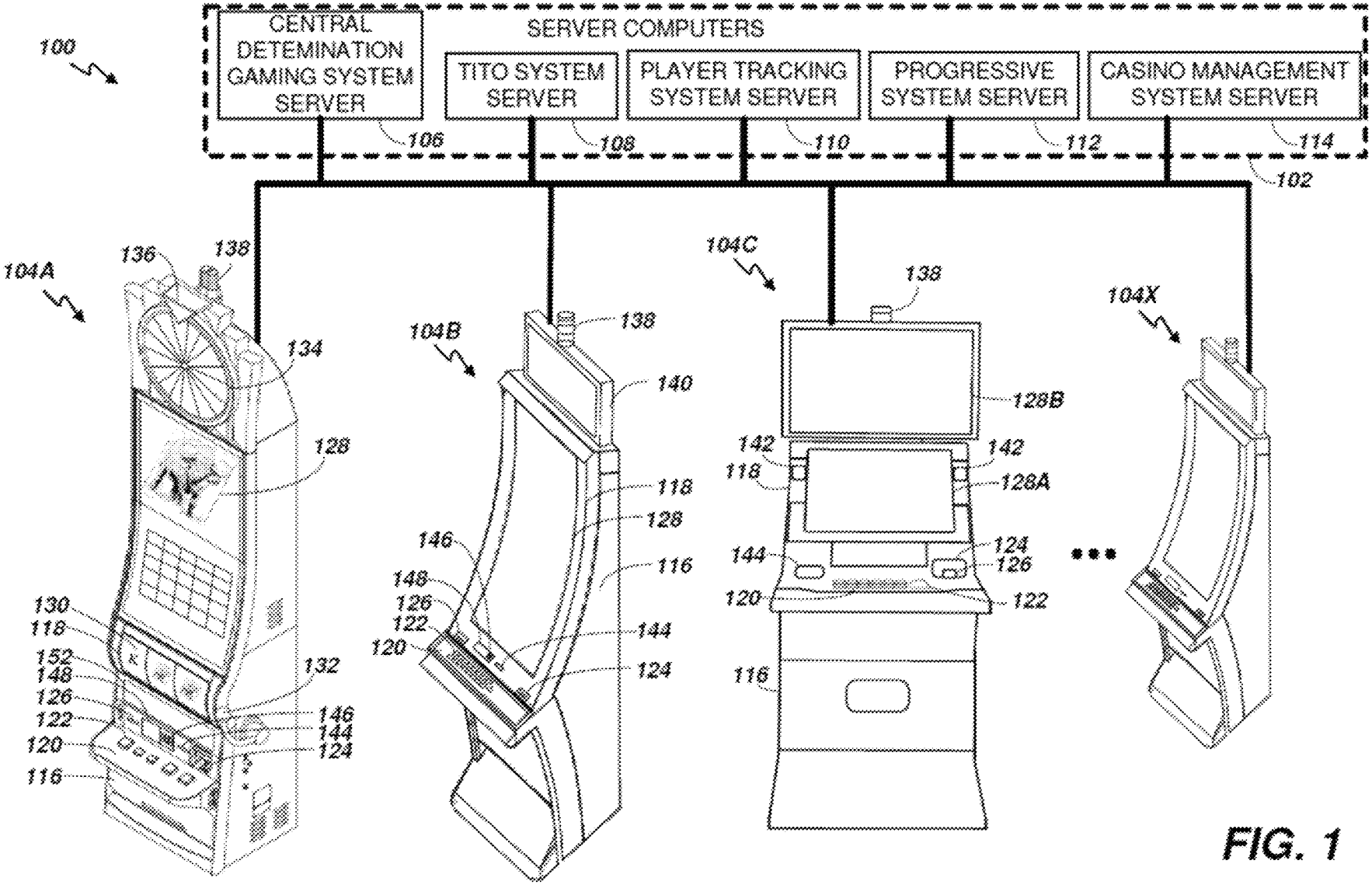
FIG. 1 is an exemplary diagram showing several EGMs networked with various gaming related servers.

FIG. 1 illustrates several different models of EGMs which may be networked to various gaming related servers. Embodiments of the disclosed technology can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the disclosed technology may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 116 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game. In embodiments where the reels are mechanical, mechanisms can be employed to implement greater functionality. For example, the boundaries of the gaming display area boundaries of the gaming display area 118 may be defined by one or more mechanical shutters controllable by a processor. The mechanical shutters may be controlled to open and close, to correspondingly reveal and conceal more or fewer symbol positions from the mechanical reels 130. For example, a top boundary of the gaming display area 118 may be raised by moving a corresponding mechanical shutter upwards to reveal an additional row of symbol positions on stopped mechanical reels. Further, a transparent or translucent display panel may be overlaid on the gaming display area 118 and controlled to override or supplement what is displayed on one or more of the mechanical reel(s).

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking server system 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
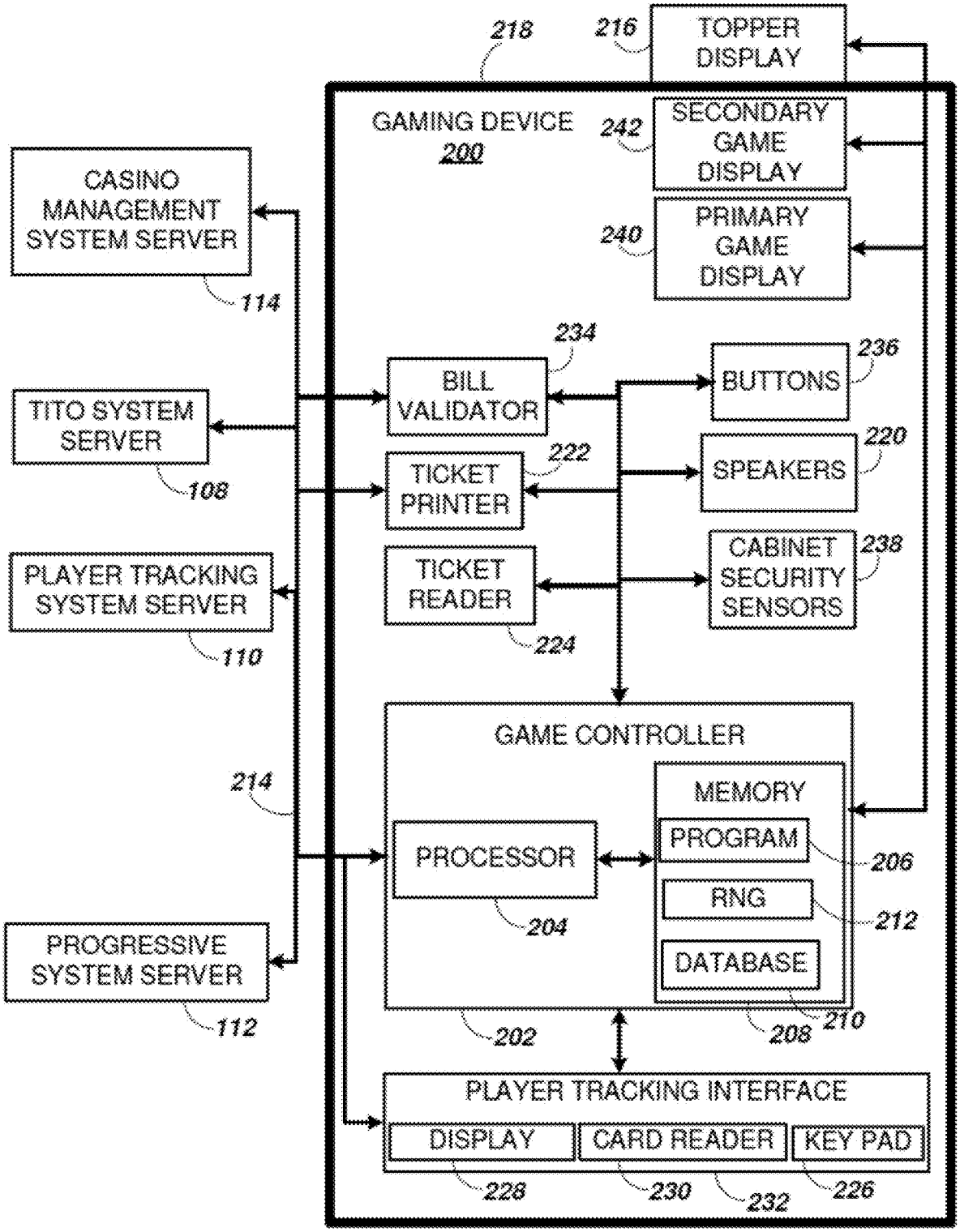
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the disclosed technology necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118 which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video blackjack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the random number generator 212 is a pseudo-random number generator.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

One regulatory requirement for games running on gaming device 200 generally involves complying with a certain level of randomness (e.g., that outcomes will be statistically independent, uniformly distributed over their range, unpredictable and pass statistical tests such as chi-square test, equi-distribution test, gap test, runs test, serial correlation test, etc.). Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG 212 can be integrated into the game controller 202 or processor 204. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. (Gaming regulations may require that each reel outcome be independent of each other reel outcome, such that no reel outcome depends on any other reel outcome.) In another example, gaming device 200 can be a Class II gaming device where RNG 212 generates RNG outcomes for creating Bingo cards. In one or more embodiments, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%).

A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

To meet a designated RTP, a game developer can utilize one or more lookup tables (e.g., weighted tables) to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. A RNG conversion operation could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

FIG. 3 illustrates an example of a set 300 of five reel strips 321, 322, 323, 324, 325. In the example, each reel strip has fifteen reel strip positions 301-315. Each reel strip position of each reel has a symbol For example, a "Wild" symbol 331 occupies the sixth reel strip position 306 of the fourth reel 324. Other reels strips to those illustrated in FIG. 3 can be used, for example, reel strips where two or more wild symbols are placed at consecutive reel strip positions of a reel strip. In other examples, the reel strips could have between 30 and 100 reel strip positions. The actual length of the feature game reel strips would depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP).

Figure 4:
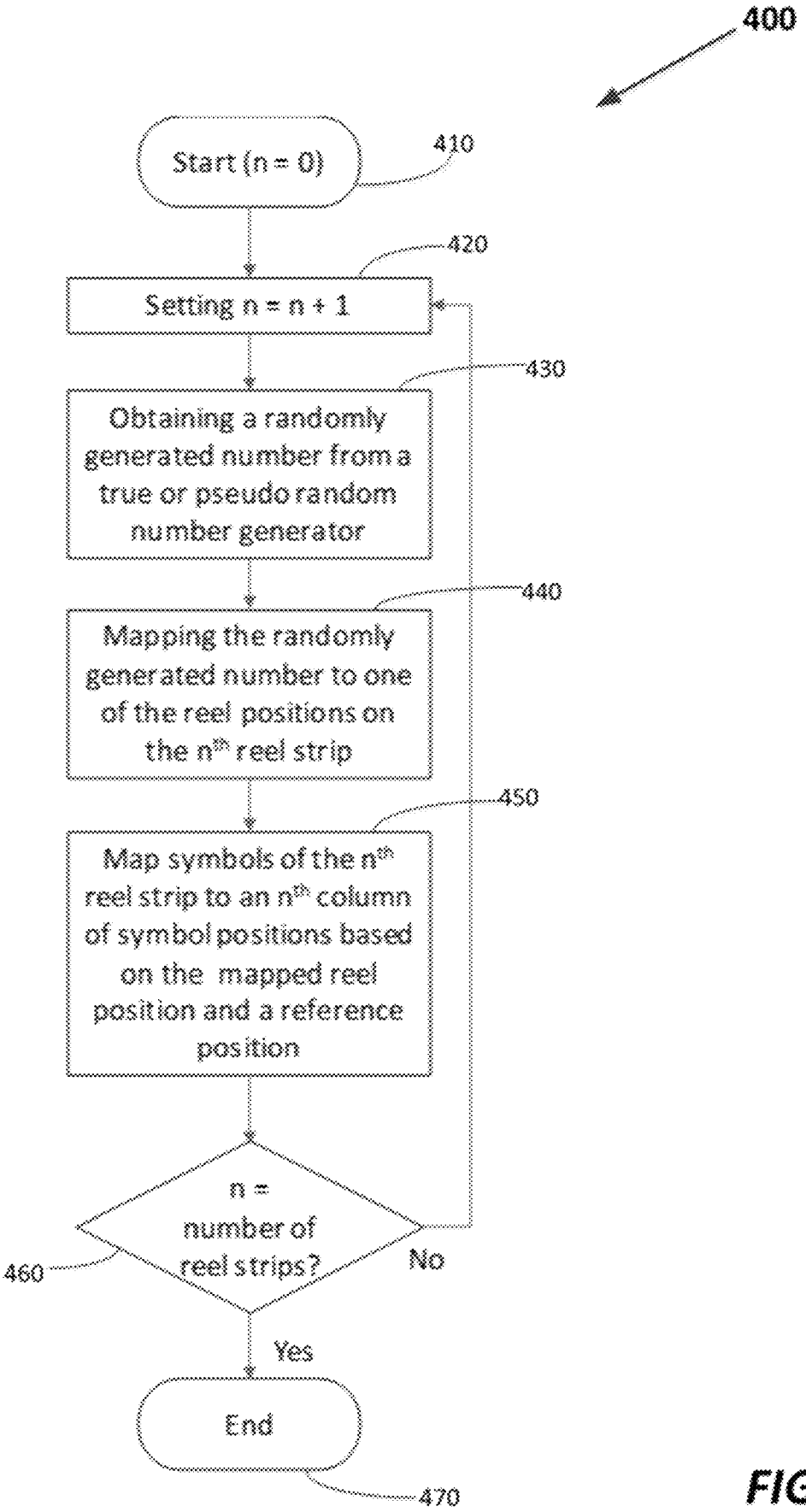
FIG. 4 is a flow chart of a symbol selection method.

FIG. 4 is a flow chart of a method 400 carried out by the processor 204 to select symbols from reel strips. At step 410, the processor 204 starts the process of selecting symbols with a counter (n) set at zero as symbols have not yet been selected from any reel strips. At step 420, the processor 204 increments the counter. In the first iteration, the counter is set to 1 to reflect that symbols are to be selected from a first reel strip. At step 430 the processor obtains a randomly generated number from a true or pseudo random number generator 212. At step 440 the processor maps the generated number to one of the reel positions of the $n^{th}$ reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a look-up table. In one example, the ranges are each the same size so that each of the reel strip positions has the same chance of been selected. In other examples, the ranges may be arranged to weight the relative chances of selecting specific reel strip positions. The reel strips may be of different lengths.

At step 450, the processor 204 maps symbols of the nth reel strip to and nth column of symbol display positions based on the mapped reel position and a reference position. In an example, the reference position is the bottom position of the symbol positions of each column of symbol positions. In this example, the selected reel position (and hence the symbol at this position) is mapped to the bottom symbol position of the column. In an example, there are two other symbol positions in the column of symbol positions and hence symbols at two neighbouring reel strip positions are also mapped to the symbol positions of the column. Referring to the example reel strips of FIG. 3, if the value returned by the RNG 212 is mapped to reel position 313, then for the first reel strip 321, "Pic3" symbol 343 is mapped to a bottom symbol position, "10" symbol 342 is mapped to a middle symbol position, and "J" symbol is mapped to a top symbol position.

At step 460, the processor 460 determines whether symbols have been selected for all of the reel strips, and if not the processor reverts to step 420 and iterates through steps 430, 440 and 450 until it is determined at step 460 that symbols have been selected from all n reel strips and mapped to all n columns of symbol positions after which the symbol selection process ends 470. Different numbers of symbols may be mapped to different numbers of symbol positions.

After the symbols of all reel strips have been mapped to symbol position, the processor 204 controls display 240 to display them at the symbol positions.

Figure 5A:
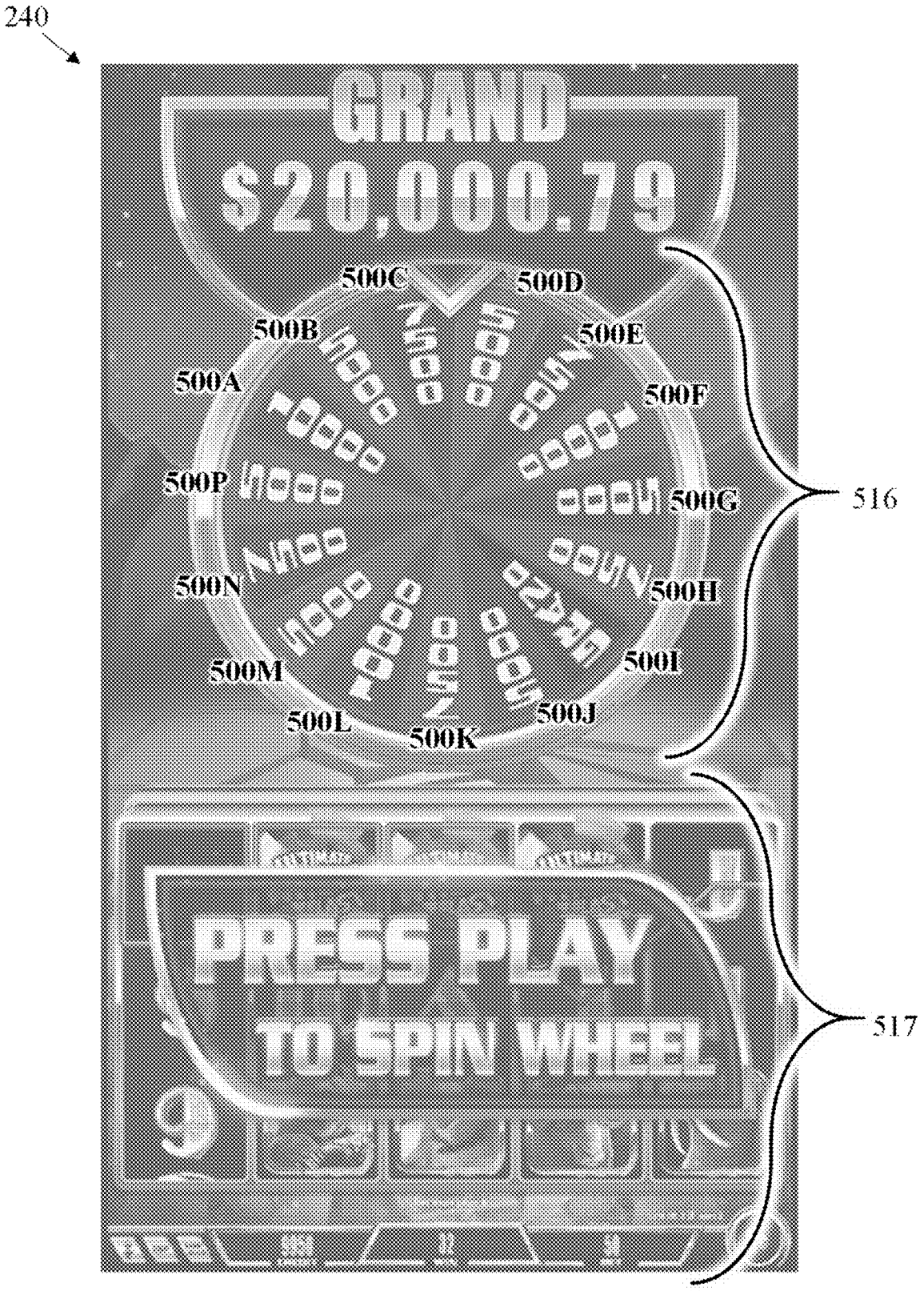
FIGS. 5*a*, 5*b*, and 5*c* illustrate a sequence of stages during a game instance of a game including a plurality of game symbols according to an embodiment.
Figure 5B:
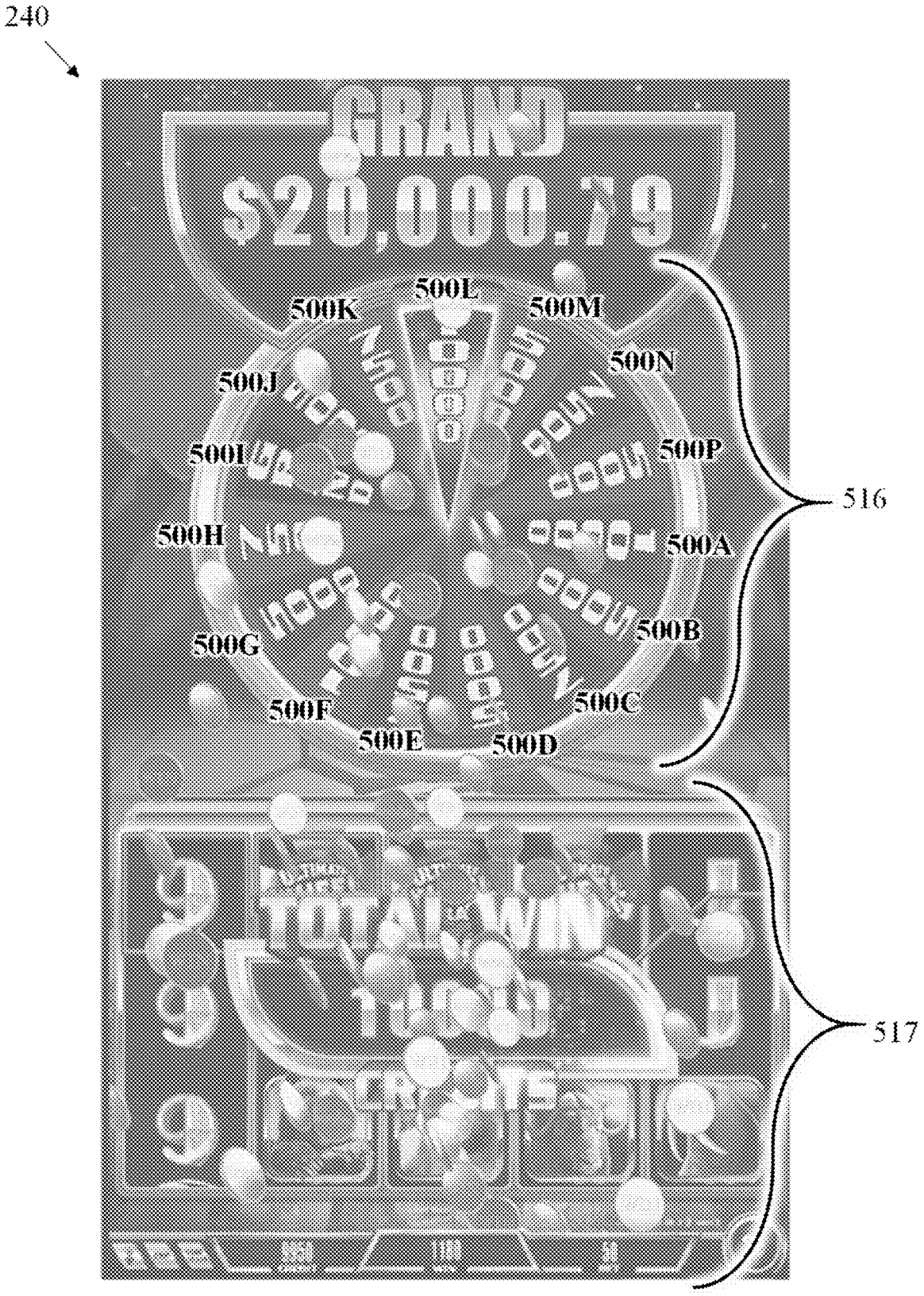

FIGS. 5*a* and 5*b* show an arrangement of game symbols 500 according to an embodiment of the disclosed technology. In the illustrated embodiment, the game symbols 500 are displayed on a primary game display 240 of gaming device 200. However, generally, depending on the embodiment, the arrangement of game symbols 500 can be shown on the primary game display 240 or, where utilized, a secondary game display 242, a topper display 216, or in fact any other suitable display of gaming device 200. In the embodiment shown, the game symbols 500 are part of a bonus game 516. In this embodiment, the primary game 517 is also shown on the primary game display 240, below the bonus game 516. The primary game 517 may be a reel game as described with reference to FIG. 4.

In the embodiment shown, each game symbol 500 is associated with a game action selected from a first game action and a second game action. More generally, each game symbol 500 is associated with one of a plurality of game actions. In the figures herein, specific game symbols 500 are indicated by a unique uppercase letter suffix. For example, game symbol 500A in FIG. 5*a* is the same as game symbol 500A FIG. 5*b*. Generally, a graphical representation of a particular game symbol 500 can change during gameplay. Where reference a particular game symbol 500 is unnecessary, the suffix is omitted. When reference is made to a specific game symbol 500 the suffix is retained (e.g. game symbol 500A in FIG. 5*a*).

The memory 208 has stored therein game rules and the processor 204 is configured to generate a game result by undertaking gameplay in accordance with the game rules. Here, gameplay corresponds to the processor 204 determining an initial game state and applying the game rules to the initial game state to produce the game result. The game result includes the selection of one of the game symbols 500.

A particular initial game state defines which game action associated with each game symbol 500. Typically, the initial game state also includes the particular display arrangement of the game symbols 500 or at least the relative arrangement of each game symbol 500 with respect to the other game symbols 500 (for example, the arrangement of game symbols 500 shown in FIGS. 5*a* and 5*b*).

In an embodiment, as shown in FIGS. 5*a* and 5*b*, game symbols 500 associated with the first game result display a prize value (e.g. "5000" at game symbol 500P). Game symbols 500 associated with the second game action can display a prize value or, alternatively, some other value such as the word "GRAND" for game symbol 5001 in FIG. 5*a*. It is preferred that the game symbols 500 associated with the second game action are distinguished visually from game symbols 500 associated with the first game result. For example, through display of a specific word (such as "GRAND"), a unique color, border, or any other suitable distinguishing characteristic such that the player can visually determine which game symbols 500 are associated with the first game result and which game symbols are associated with the second game action.

The processor 204 is configured to cause a visual representation of the initial game state to be shown on the primary game display 240 and a visual representation showing each game symbol 500A-500P and its associated display value, for example, in the secondary game display 242. In an embodiment, each game symbol 500 is consistently (between at least two consecutive game instances) associated with the same prize value—in this case, it is the display of the prize value that is determined in accordance the game result currently associated with the game symbol 500. In another embodiment, the game symbols 500 may be displayed in different positions on the secondary game display 242, for example on a subsequent game instance; however, it may be generally preferred that the relative locations of the game symbols 500 with respect to each other game symbol 500 remains consistent.

A game result includes a selection of one of the game symbols 500. The game rules may define a probability set specifying a probability of selecting each one of the game symbols 500 and the processor 204 is configured to determine the selected game symbol 500 in accordance with the probability set. In an embodiment, the game rules define modifications to the probability set (or in fact, a plurality of different probability sets) such that the probability of selecting each game symbol 500 is variable and determined at least in part on the basis of the current initial game state. For example, the number of game symbols 500 associated with the second game action may, at least in part, determine the probability set.

In an embodiment, a first transition animation is present on the primary game display 240. The first transition animation provides a visual indication of the determination of the game result. For example, the first transition animation may include highlighting of the selected game symbol 500. Referring to FIG. 5*b*, game symbol 500L is shown as being selected via a highlighted outside border of the game symbol 500L and other visual effects. The first transition animation can include other visual effects such as "spinning" of the game symbols 500A-500P; as can be seen in FIG. 5*b*, the positions of the game symbols 500 has changed with respect to FIG. 5*a* while the relative positions of the game symbols 500 with respect to one another has not changed. The first transition animation can be conducted commensurate with, or after, the determination of the game result. Generally, the first transition animation occurs over a significantly longer period of time (e.g. 1-10 seconds) than the required time to determine the game result. It may be preferred that the game result is determined before the first transition animation begins.

According to an embodiment, when a game symbol 500 is selected associated with the first game action as a result of a game instance, the game action associated with the selected game symbol 500 is changed from the first game action to the second game action. This is typically accompanied by a second transition animation providing a visual indication of the change to the associated second game action. Additionally, a prize may be awarded according to the prize value associated with the selected game symbol 500. Typically, the prize award is added to a cumulative bonus prize. It may be preferred at this stage that the display value associated with the selected game symbol 500 is changed to reflect the change in association to the second game action.

Figure 5C:
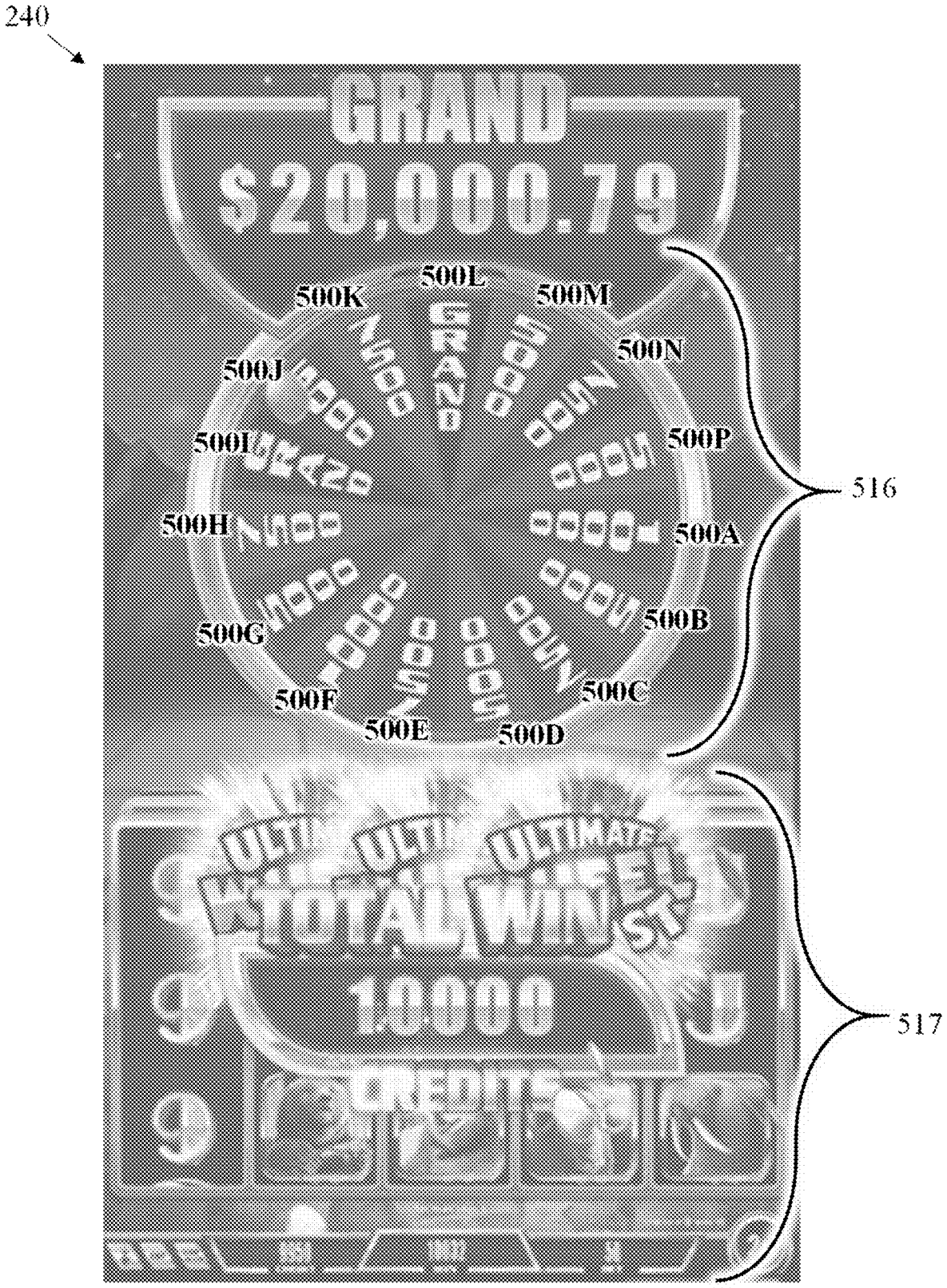

Referring to FIG. 5*b*, game symbol 500L is selected, which is associated with a first game action. The prize value associated with this game symbol 500L is "1000". As can be seen, with reference to FIG. 5*c*, the representation of game symbol 500L changes from "1000" (being related to its prize value) to "GRAND". Thus, game symbol 500L is now associated (in FIG. 5*c*) with the second game action.

According to an embodiment, when a game symbol 500 is selected associated with the second game action as a result of a game instance, a secondary game event occurs. In an embodiment, the secondary game event includes a reset event (see below). However, generally, the secondary game event is any game action not corresponding to the award of a prize corresponding to the prize value of the selected game symbol 500. It should be noted that, in an embodiment, an award of a prize corresponding to the prize value is made in addition to the secondary game event. In an embodiment, the secondary game event includes a payout of a cumulative bonus prize.

According to an embodiment, unless a reset event has occurred, the result of the game instance is a final game state. As with the initial game state, the final game state includes the game action associated with each game symbol 500 and a display value associated with each game symbol 500. Also, typically, the final game state also includes the particular display arrangement of the game symbols 500 or at least the relative arrangement of each game symbol 500 with respect to the other game symbols 500 (for example, the arrangement of game symbols 500 shown in FIGS. 5*a* and 5*b*). It should therefore be apparent that the final game state may correspond to a to change to the initial game state.

In an embodiment, the final game state is utilized in the next game instance as that game instance's initial game state, except in instances where the processor 204 detects a reset condition. An advantage of this embodiment is that the player of the gaming machine 200 perceives that each game instance is related to the previous game instance.

A reset condition corresponds to the processor 204 determining that the initial game state of a next game instance should be different to the final game state of the most recent preceding game instance. In one trivial example, a reset condition is equivalent to initiation of the gaming machine 200 (e.g. by powering on the gaming machine 200). In response to determining a reset condition, the processor 204 determines an initial game state based on an initial game state determination rule stored in the memory 208.

In one embodiment, a default initial game state is stored in the memory 208 and the initial game state determination rule corresponds simply to obtaining the default initial game state from the memory 208 and utilizing it as the initial game state.

In another embodiment, the initial game state determination rule includes, at least in part, a random component. For example, the initial game state determination rule may specify the prize values that must be associated to the game symbols 500, however, the specific game symbol 500 associated with each prize value may be random. Generally, the initial game state determination rule also specifies how many game symbols 500 are to be associated with first game actions and how many game symbols 500 are to be associated with second game actions. Generally, it is expected that the initial game state determination rule is such as to satisfy the particular requirements of the gaming machine 2.

For example, the representation shown in FIG. 5*a* may correspond to an initial game state determined subsequent to a reset condition.

In an embodiment, a reset condition corresponds to selection, during a game instance, of a game symbol 500 associated with the second game action. After completion of the game instance (and, for example, the first transition animation), and reset transition animation is displayed showing the game symbols 500 changing from final game state to an initial game state determined according to the initial game state determination rule.

In an embodiment, the determination of a reset condition by the processor 204 also results in the completion of the cumulative bonus prize. The cumulative bonus prize may be converted into a receivable bonus prize and then returned to its default value. The receivable bonus prize is then made available to the player, either as a payout, credit, or any other suitable prize.

Figure 6:
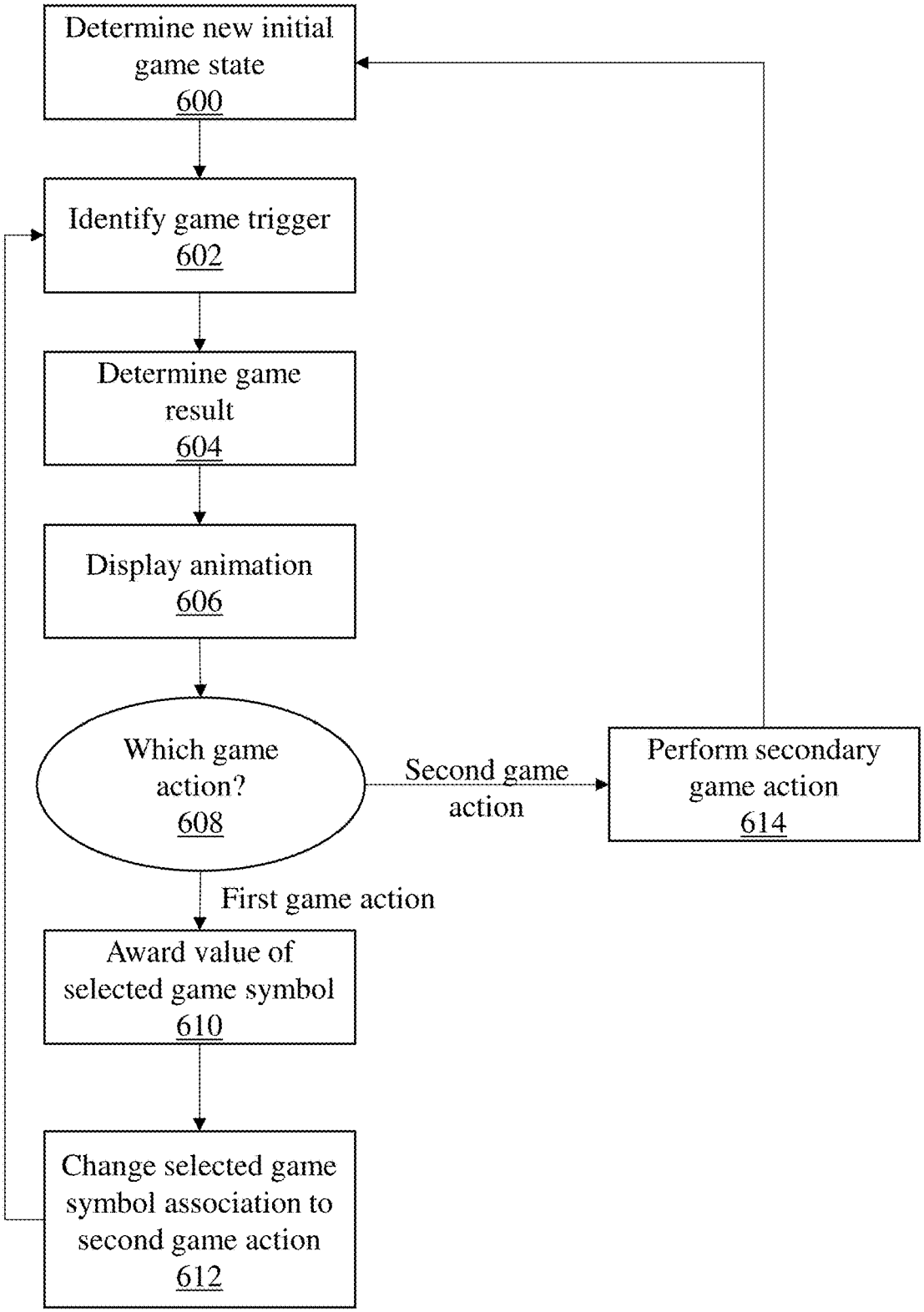
FIG. 6 is a flow chart showing gameplay according to an embodiment.

A method for game play is shown in FIG. 6. A first initial game state is determined, at step 600. This initial game state is not determined to be the same as the final game state of a previous game instance. For example, the first initial game state may be a default state activated when a new player begins gameplay of the gaming machine 200 or as a result of a previous secondary game event. The processor 204 then detects a game trigger at step 602. The game trigger can be, for example, a particular game result of a primary game played on the gaming machine 200. Any other suitable game trigger may be employed. For example, a player may provide an input corresponding to a game trigger at a suitable time via a player input.

At step 604, the processor 204 applies the game rules to the current initial game state in order to determine a game result. At step 606 (which can occur subsequently or simultaneously with step 104), the processor 204 causes an animation to be presented on the primary game display 240 which, in part, is configured to inform the player of the game result. At step 608, a check is made as to whether the game symbol 500 selected (corresponding to the game result) is associated with a first game action or a second game action.

If associated with a first game action, the method proceeds to step 610 where a value of the selected game symbol 500 is awarded—typically, as an addition to a cumulative bonus prize. The selected game symbol 500 is then changed to be associated with the second game action (and, typically, a visual change is accordingly made to the game symbol 500), at step 612. The result of step 612 is a final game state. The method then returns to step 602 utilizing this final game state as the new initial game state.

On the other hand, if at step 608 it is determined that the selected game symbol 500 is associated with a second game action, then at step 614 a secondary game event is implemented. In the embodiment shown, the method then returns to step 100 (however, other actions can be taken in addition or alternatively).

An example embodiment provides a method for operating a gaming device, the method comprising: determining an current game state; displaying a visual representation of the current game state comprising a plurality of game symbols, each associated with one of a first game action and a second game action, wherein each game symbol associated with a first game action is associated with a prize award; performing a game instance comprising selecting a game symbol from the plurality of game symbols; determining that the selected game symbol is associated with the first game action and awarding a prize associated with the selected game symbol; changing the association of the selected game symbol from the first game action to the second game action thereby creating a new game state; displaying a visual representation of the change in association of the selected game symbol; and performing a second game instance utilizing the new game state as the current game state, wherein the initial game state comprises at least one game symbol associated with the first game action and at least one game symbol associated with the second game action, and wherein the second game action is associated with a secondary game event.

The game symbol may be selected in response to detection of a game trigger. The game trigger may be a game result of another game played on the gaming device. The other game may be a reel game and the game trigger may correspond to the presence and/or selection of a particular game symbol, or one of a selection of particular game symbols, of the other game.

The prize associated with the selected game symbol may include a numerical prize which is added to a cumulative bonus prize.

The selected game symbol may be selected in accordance with the probability set defining the probability of selecting each game symbol.

The method may further comprise the steps of: repeating game instances until determining that a selected game symbol is associated with the second game action; in response, undertaking the secondary game event associated with the secondary game action. The secondary game event may comprise a reset condition. The reset condition may result in a determination of a new current game state that is unrelated to an immediately preceding game state. The secondary game event may comprise making a payout of the cumulative bonus prize.

The game symbols may be associated with the second game action do not display a numerical value.

An example embodiment provides a gaming device comprising: a display; a processor; and a memory storing instructions which when executed by the processor, cause the processor to: determine an current game state; display a visual representation of the current game state comprising a plurality of game symbols, each associated with one of a first game action and a second game action, wherein each game symbol associated with a first game action is associated with a prize award; perform a game instance comprising selecting a game symbol from the plurality of game symbols; determine that the selected game symbol is associated with the first game action and awarding a prize associated with the selected game symbol; change the association of the selected game symbol from the first game action to the second game action thereby creating a new game state; display a visual representation of the change in association of the selected game symbol; and perform a second game instance utilizing the new game state as the current game state, wherein the initial game state comprises at least one game symbol associated with the first game action and at least one game symbol associated with the second game action, and wherein the second game action is associated with a secondary game event.

The game symbol may be selected in response to detection of a game trigger. The gaming device may be configured to implement gameplay of another game, and the game trigger may be a game result of another game played on the gaming device. The other game may be a reel game and the game trigger may correspond to the presence and/or selection of a particular game symbol, or one of a selection of particular game symbols, of the other game.

The prize associated with the selected game symbol may include a numerical prize which is added to a cumulative bonus prize.

The selected game symbol may be selected in accordance with the probability set defining the probability of selecting each game symbol.

The gaming device may be configured to: repeat game instances until determining that a selected game symbol is associated with the second game action; in response, undertake the secondary game event associated with the secondary game action. The secondary game event may comprise a reset condition. The reset condition may result in a determination of a new current game state that is unrelated to an immediately preceding game state. The secondary game event may comprise making a payout of the cumulative bonus prize.

The game symbols associated with the second game action may not display a numerical value.

An example embodiment provides a gaming system comprising: a display; one or more processors; and at least one memory storing instructions which when executed by the one or more processors, cause the one or more processors to: determine an current game state; display a visual representation of the current game state comprising a plurality of game symbols, each associated with one of a first game action and a second game action, wherein each game symbol associated with a first game action is associated with a prize award; perform a game instance comprising selecting a game symbol from the plurality of game symbols; determine that the selected game symbol is associated with the first game action and awarding a prize associated with the selected game symbol; change the association of the selected game symbol from the first game action to the second game action thereby creating a new game state; display a visual representation of the change in association of the selected game symbol; and perform a second game instance utilizing the new game state as the current game state, wherein the initial game state comprises at least one game symbol associated with the first game action and at least one game symbol associated with the second game action, and wherein the second game action is associated with a secondary game event.

An example embodiment provides a computer program code which when executed implements the method of another embodiment.

An example embodiment provides a tangible computer readable medium comprising the computer program code of another embodiment.

Another example embodiment is a system comprising at least one processor; and a memory storing instructions which when executed by the at least one processor cause the at last one processor to: control a display to display a visual representation of a current game state comprising a plurality of game symbols associated with a first game action, wherein each game symbol associated with the first game action is associated with a prize; perform a first selection in which a first game symbol is selected from the plurality of game symbols associated with the first game action; control the display to display the first selected game symbol associated with the first game action; alter the first selected game symbol from the first game action to an altered game symbol associated with a second game action; and control the display to display an animation showing the alteration of the first selected game symbol. In particular example implementations, the second game action includes at least one symbol that triggers a reset condition. In one example, the reset condition results in a new game state that is different from the current game state. In some example implementations, the instructions, which when executed by the processor, cause the processor to: perform a second selection in which a game symbol is selected from the plurality of game symbols associated with the second game action in which the altered game symbol is available for selection; and control the display to display the second selected game symbol associated with the second game action. In certain example implementations, the first game action is part of a secondary game feature triggered by achievement of a result from a primary game. In some example implementations, the reset condition returns game symbols of the secondary game feature to an initial condition. In certain example implementations, the plurality of game symbols associated with the first game action game is variable dependent on an outcome of the primary game. In some example implementations, the plurality of game symbols associated with the second game action includes a game symbol for a progressive prize. In certain example implementations, the altered game symbol is for a previously unavailable progressive prize. In some example implementations, the second game action is triggered by a selection of a particular game symbol in the outcome of the first game action. In certain example implementations, the altering is performed responsive to a particular set of game symbols resulting from the first game action. In some example implementations, the prize associated with the selected game symbol includes a numerical prize that is added to a cumulative bonus prize. In certain example implementations, the selected game symbol is selected in accordance with a probability set defining the probability of selecting each game symbol. In some example implementations, the memory storing instructions which when executed by the processor further causes the processor to repeat game instances of the first game action until achievement of a game symbol associated with the second game action. In further example implementations, the memory storing instructions which when executed by the processor further causes the processor to, upon the achievement of the game symbol associated with the second game action, initiate the control of the display to display the animation showing the alteration of the first selected game symbol. In some example implementations, one or more game symbols associated with the second game action do not display a numerical value. In certain example implementations, at least one of the altered one or more of the plurality of game symbols of the secondary game features includes at least one of the selected one of the plurality of game symbols. In some example implementations, at least one of the altered one or more of the plurality of game symbols of the secondary game feature provides a greater award than an earlier award. In certain example implementations, the first selected game symbol associated with the first game action is displayed as a pie slice of a computer-generated rotating wheel. In some example implementations, the first game action is part of a secondary game feature triggered by achievement of a result from a reel game, and wherein the first and second game action are displayed simultaneously with the reel game. In certain examples, the system comprises an electronic gaming machine ("EGM") or the system is a server in communication with one or more EGMs.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A system, comprising:

at least one processor; and a memory storing instructions which when executed by the at least one processor cause the at least one processor to:

control a display to display a visual representation of a current game state comprising a plurality of game symbols associated with a first game action, wherein each game symbol associated with the first game action is associated with a prize;

perform a first selection in which a first game symbol is selected from the plurality of game symbols associated with the first game action, wherein the first selected game symbol associated with the first game action is displayed as a pie slice of a computer-generated rotating wheel;

control the display to display the first selected game symbol associated with the first game action;

alter the first selected game symbol from the first game action to an altered game symbol associated with a second game action; and control the display to display an animation showing the alteration of the first selected game symbol, wherein the second game action is associated with at least one game symbol that triggers a reset condition, and wherein the reset condition results in a new game state that is different from the current game state.

2. The system of claim 1, wherein the instructions, when executed by the at least one processor, further cause the at least processor to:

perform a second selection in which a game symbol is selected from the at least one symbol associated with the second game action in which the altered game symbol is available for selection; and control the display to display the second selected game symbol associated with the second game action.

3. The system of claim 1, wherein the first game action is part of a secondary game feature triggered by achievement of a result from a primary game.

4. The system of claim 3, wherein the reset condition returns game symbols of the secondary game feature to an initial condition.

5. The system of claim 3, wherein the plurality of game symbols associated with the first game action is variable dependent on an outcome of the primary game.

6. The system of claim 1, wherein the altered game symbol is for a previously unavailable progressive prize.

7. The system of claim 1, wherein the second game action is triggered by a selection of a particular game symbol in an outcome of the first game action.

8. The system of claim 1, wherein the altering is performed responsive to a particular set of game symbols resulting from the first game action.

9. The system of claim 1, wherein the prize associated with a selected game symbol includes a numerical prize that is added to a progressive prize.

10. The system of claim 1, wherein a selected game symbol is selected in accordance with a probability set defining a probability of selecting each game symbol.

11. The system of claim 1, wherein the instructions, when executed by the at least one processor, further cause the at least one processor to:

repeat game instances of the first game action until selection of a game symbol associated with the second game action.

12. The system of claim 11, wherein the instructions, when executed by the at least one processor, further cause the at least one processor to:

upon the selection of the game symbol associated with the second game action, initiating the control of the display to display the animation showing the alteration of the first selected game symbol.

13. The system of claim 1, wherein the at least one symbol associated with the second game action does not display a numerical value.

14. The system of claim 1, wherein the altered game symbol provides a greater award than an earlier award.

15. The system of claim 1, wherein the first game action is part of a secondary game feature triggered by achievement of a result from a reel game, and wherein the first and second game actions are displayed simultaneously with the reel game.

16. The system of claim 1, wherein the system is a server in communication with one or more EGMs.

17. The system of claim 1, wherein the reset condition causes a prize value for at least the first game symbol to reset to an initial value.

18. A computer-performed method, comprising:

controlling a display to display a visual representation of a current game state comprising a plurality of game symbols associated with a first game action, wherein each game symbol associated with the first game action is associated with a prize;

performing a first selection in which a first game symbol is selected from the plurality of game symbols associated with the first game action, wherein the first selected game symbol associated with the first game action is displayed as a pie slice of a computer-generated rotating wheel;

controlling the display to display the first selected game symbol associated with the first game action;

altering the first selected game symbol from the first game action to an altered game symbol associated with a second game action, the second game action associated with at least one symbol that triggers a reset condition, the reset condition resulting in a new game state that is different from the current game state; and controlling the display to display an animation showing the alteration of the first selected game symbol.

19. The method of claim 18, wherein the at least one symbol associated with the second game action includes a game symbol for a progressive prize.

20. The method of claim 19, wherein the progressive prize is a previously unavailable progressive prize.

* * * * *